United States Patent [19]

Turner

[11] Patent Number: 4,821,918

[45] Date of Patent: Apr. 18, 1989

[54] LABEL DISPENSER AND HOLDER

[75] Inventor: Paul F. Turner, Earlham, Iowa

[73] Assignee: Net Associates, Inc., Des Moines, Iowa

[21] Appl. No.: 45,531

[22] Filed: May 4, 1987

[51] Int. Cl.[4] ..... B65H 5/28

[52] U.S. Cl. ..... 221/70; 221/73; 221/92; 221/283; 156/584; 248/214; 242/55.3; 312/39

[58] Field of Search ..... 221/70, 71, 72, 73, 221/74, 92, 197, 282, 283, 285, 286, 311; 222/175, 180; 156/584; 211/175; 248/214, 309.1; 206/389, 390, 391, 409, 411; 242/55.2, 55.3, 55.53, 76; 312/39

[56] References Cited

U.S. PATENT DOCUMENTS

| | | | |
|---|---|---|---|
| 1,487,607 | 3/1924 | Rosen | 242/55.3 |
| 2,372,245 | 3/1945 | Avery | 221/70 |
| 2,373,092 | 4/1945 | Avery | 156/584 X |
| 2,616,599 | 11/1952 | Hryhorczuk | 248/214 X |
| 2,838,171 | 6/1958 | Kaspar | 221/70 |
| 2,912,140 | 11/1959 | Cole | 221/73 X |
| 3,231,130 | 1/1966 | Foote | 221/70 |
| 3,388,830 | 6/1968 | Short | 221/73 |
| 3,547,327 | 12/1970 | Mariani | 242/55.3 X |
| 3,554,847 | 1/1971 | Broemmlsiek | 156/584 |
| 3,698,600 | 10/1972 | Foote | 221/73 X |
| 3,793,123 | 2/1974 | Aronson | 156/584 |
| 4,252,258 | 2/1981 | Plummer, III | 242/55.3 X |

FOREIGN PATENT DOCUMENTS

| | | | |
|---|---|---|---|
| 1349490 | 3/1964 | France | 221/70 |

*Primary Examiner*—Joseph J. Rolla
*Assistant Examiner*—Edward S. Ammeen
*Attorney, Agent, or Firm*—Zarley, McKee, Thomte, Voorhees & Sease

[57] ABSTRACT

The label dispenser and holder includes a rectangular frame having a bottom support member, a top member, a pair of spaced apart end members, a back member, and a front member. At least two rectangular label dispensers are positioned within the holder. The holder includes various brackets which permit it to be universally mounted to various types of supporting surfaces, including a bracket for detachably securing the holder to a person's belt. The dispenser box of the present invention includes a pair of spaced apart slits in the side wall of the box. A guide member is within the box and includes a central portion positioned adjacent one of the slots and a pair of leaf portions extending in opposite directions from the central portion. The leaf portions and the central portion are in close spaced relationship to the side wall adjacent the elongated slot.

13 Claims, 2 Drawing Sheets

LABEL DISPENSER AND HOLDER

BACKGROUND OF THE INVENTION

The present invention relates to a label dispenser and holder.

The U.S. Postal Office requires bulk mailings to be sorted and to contain separate labels for identifying various types of bundled mail. The postal service supplies to mailers rectangular paperboard boxes containing these labels, and these boxes are used to dispense the various labels during the mailing process.

The boxes supplied by the U.S. Postal Service are difficult to handle, and are particularly difficult to handle when dealing with large volumes of mail as is the case in providing custom printing and mailing services.

Therefore, a primary object of the present invention is the provision of an improved label dispenser and holder.

A further object of the present invention is the provision of a holder for label dispensers which includes brackets for universally attaching the holder to various types of surfaces and tables.

A further object of the present invention is the provision of a holder for label dispensers which can be attached to a person's belt so that the person can remove the labels while standing or moving.

A further object of the present invention is the provision of an improved dispenser box which is easier to use and more durable than the dispenser boxes presently supplied by the U.S. Postal Service.

A further object of the present invention is the provision of a label dispenser and holder which is economical to manufacture, durable in use and efficient in operation.

SUMMARY OF THE INVENTION

The present invention contemplates a holder for a plurality of label dispensers. The holder includes a rectangular frame having a bottom support member, a top support member, a pair of spaced apart end members, a back member, and a front member. The label dispensers are positioned in side-by-side relationship within the rectangular frame, resting on the bottom member. At least one of the members of the rectangular frame, preferably the front member, is movable to a position which permits the insertion and removal of the rectangular dispensing boxes from the holding frame.

The holding frame of the present invention includes two L-shaped brackets which are movably attached to the holding frame, and which are capable of universal attachment to various types of table edges, table tops, partitions or sorting trays. In addition, a belt bracket is also attached to the holding frame and is capable of being detachably secured to a wearer's belt so that the holding frame can be worn on a user's belt. Rubber bands can be attached to the belt bracket for further securement of the belt bracket to the wearer's belt.

The present invention also contemplates utilizing an improved dispenser box for dispensing the labels. The dispenser box is rectangular in shape and includes at least a pair of elongated slots in its edges. A guide member is positioned within the box adjacent one of the slots and includes leaf portions extending opposite directions from the slot. A label tape is coiled within the box and includes a backing strip and a continuous label strip which is detachably adhered to the backing strip. The label tape is threaded between one of the leaf portions of the guide member and the edge wall of the dispenser box. At the slot in the dispenser box, the continuous label strip is separated from the backing strip and extends through the slot to the exterior of the box. The backing strip continues within the box between the other of the leaf portions of the guide member, and ultimately exits the box at the second slot in the guide wall. By pulling the backing strip which extends out of the rectangular box, it is possible to feed the label strip outwardly through the first mentioned slot in the box.

DETAILED DESCRIPTION OF THE PREFERRED EMBODIMENT

Figure 1:
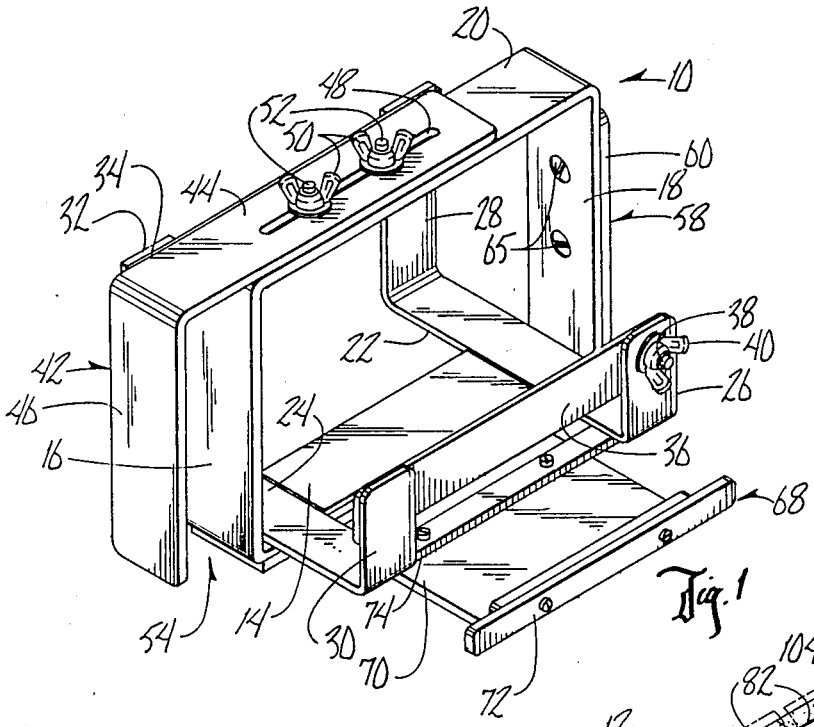
FIG. 1 is a perspective view of the holding frame of the present invention.
Figure 2:
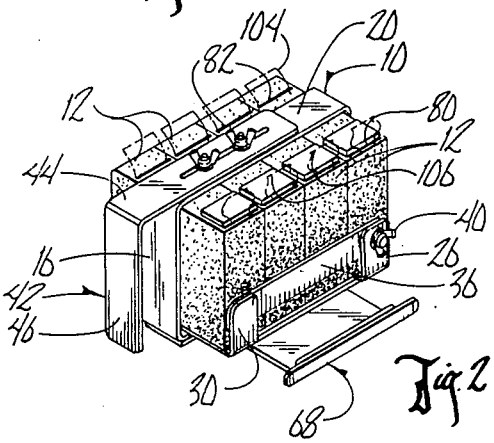
FIG. 2 is a perspective view similar to FIG. 1 showing the holding frame with four label dispensing boxes therein.
Figure 3:
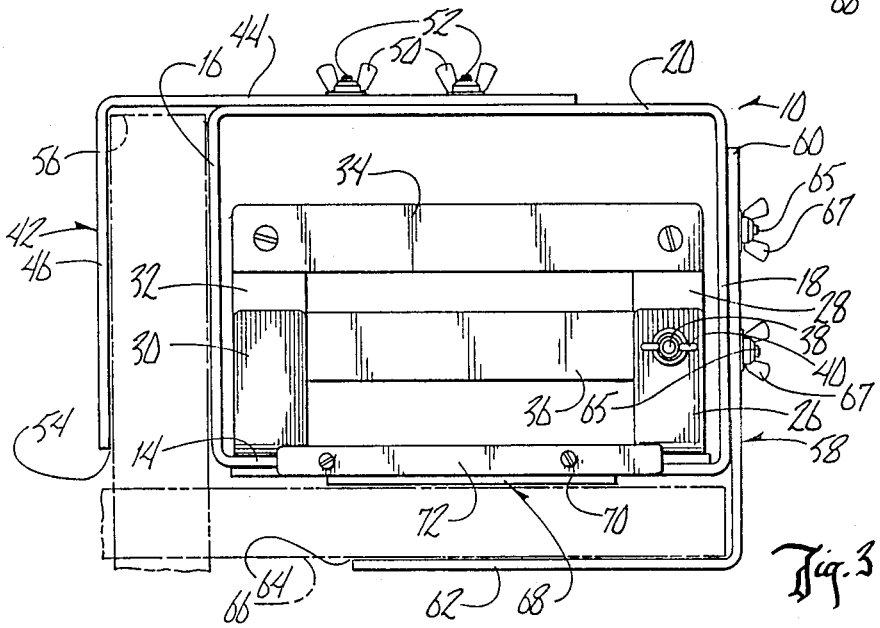
FIG. 3 is a front elevational view of the holding frame of the present invention.
Figure 4:
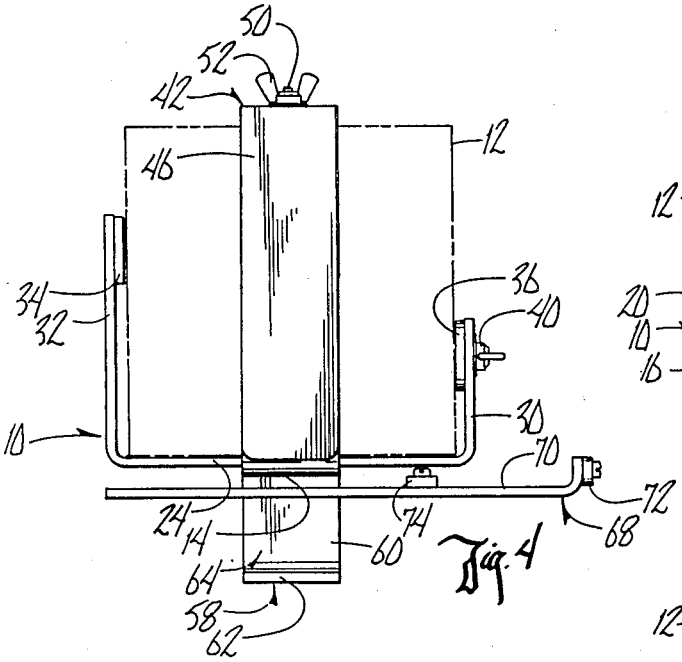
FIG. 4 is an end elevational view as viewed from the left of FIG. 3.

Referring to the drawings, the numeral 10 refers to the holding frame of the present invention. Frame 10 is used to hold a plurality of label dispenser boxes 12 (FIG. 2). Frame 10 includes a bottom frame member 14, a pair of side frame members 16, 18, and a top frame member 20. Attached to bottom frame member 14 are a pair of transverse web members 22, 24. At the forward end of web member 22 is an upstanding end portion 26 and at the other end of web frame member 22 is a rear upstanding leg portion 28. Similarly, web member 24 is provided with a front upstanding member 30 and a rear upstanding member 32. The upper ends of rear upstanding members 28, 32 are attached to the opposite ends of a back frame member 34 (FIG. 3). The front upstanding portions 26, 30 are interconnected by front frame member 36. Front frame member 36 is attached to upstanding member 26 by means of a bolt 38 and wing nut 40. By loosening wing nut 40 it is possible to pivot front frame member 36 upwardly out of blocking engagement with the dispenser boxes 12 so as to permit the dispenser boxes to be removed from the holding frame 10.

The dispenser boxes 12 are held in side-by-side relation within the holding frame 10, with the bottom frame member 14 supporting the boxes, and with the side frame members 16, 18, the top frame member 20, the front member 36, and the rear member 34 confining the boxes and holding them against movement within the holding frame.

Detachably mounted to top frame member 20 is an L-shaped bracket 42 having a first leg 44 and a second leg 46. Within first leg 44 is an elongated slot 48 which receives two bolts 52, each of which includes a wing nut 50 thereon for detachably securing the L-shaped bracket 42 to the upper frame member 20. The slot 48 permits the bracket to be adjusted longitudinally with respect to top frame member 20, thereby adjusting the distance between the second leg 46 of L-shaped bracket 42 and the side frame member 16. This provides a space 54 which can receive an upstanding wall such as wall 56 shown in FIG. 3 for supporting the holding frame 10. L-shaped bracket 42 can also be removed and reversed so as to provide a space on the right-hand side of frame 10, the space being formed between side frame member 18 and second leg 46.

A second L-shaped member 58 includes a first leg 60 and a second leg 62. First leg 60 is attached to side frame member 18 by means of bolts 65 which extend through an elongated slot 63 similar to slot 48 in the first L-shaped bracket 42. Bolts 65 extend through slot 48 and receive wing nuts 67 which permit longitudinal adjustment of L-shaped bracket 58 with respect to side frame 18 so as to permit the second leg 62 of L-shaped bracket 58 to be moved toward and away from bottom frame member 14. This provides a space 64 for accommodating a table top or shelf 66.

Figure 6:
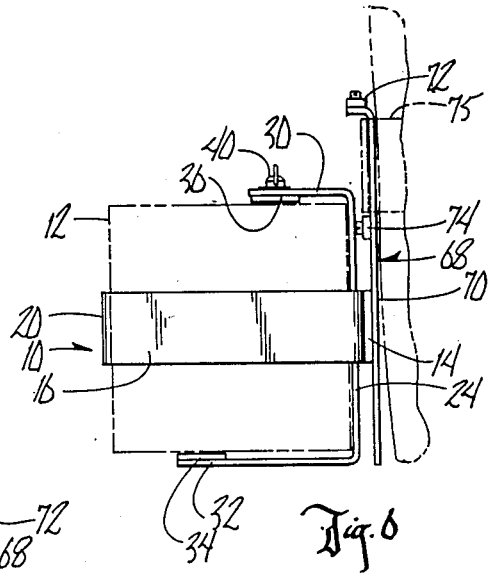
FIG. 6 is an end elevational view of the device showing the device mounted on a person's belt.
Figure 5:
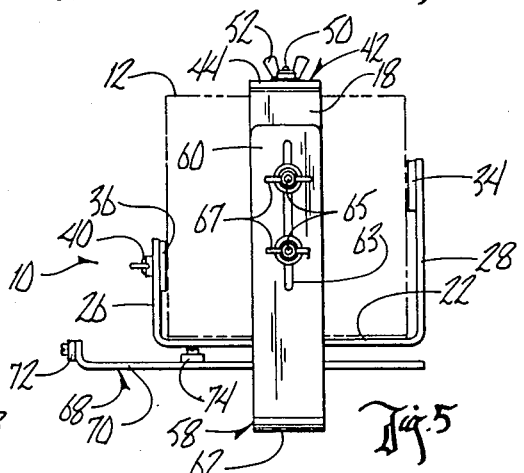
FIG. 5 is an end elevational view as viewed from the right of FIG. 3.

A belt bracket 68 is attached to the bottom surface of bottom frame member 14 and extends forwardly therefrom. Belt bracket 68 includes a horizontally extending plate 70 having an upstanding cross member 72 at its forward end and a cross member 74 spaced inwardly from cross member 72. Belt bracket 68 is used in the manner shown in FIG. 6. Belt bracket 68 is inserted beneath a wearer's belt 75 in the manner shown in FIG. 6 with cross member 72 being positioned above the wearer's belt and with cross member 74 being positioned below the wearer's belt. Plate 70 extends beneath the wearer's belt. This holds the dispenser on the wearer's belt in the manner shown in FIG. 6 and permits the wearer to move about while still keeping the dispensers in a convenient position for removal of the labels.

The various portions of holding frame 10 are shown attached to one another by bolts, welding or other means. However, it is possible for all of the various members of holding frame 10 to be molded into a single unit with the exception of the two L-shaped members 42, 58, which must necessarily be movable with respect to the remainder of the frame.

Figure 7:
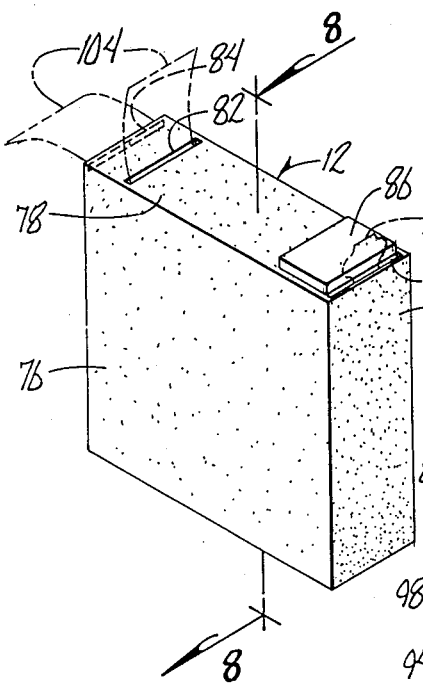
FIG. 7 is a perspective view of the dispenser box of the present invention.
Figure 8:
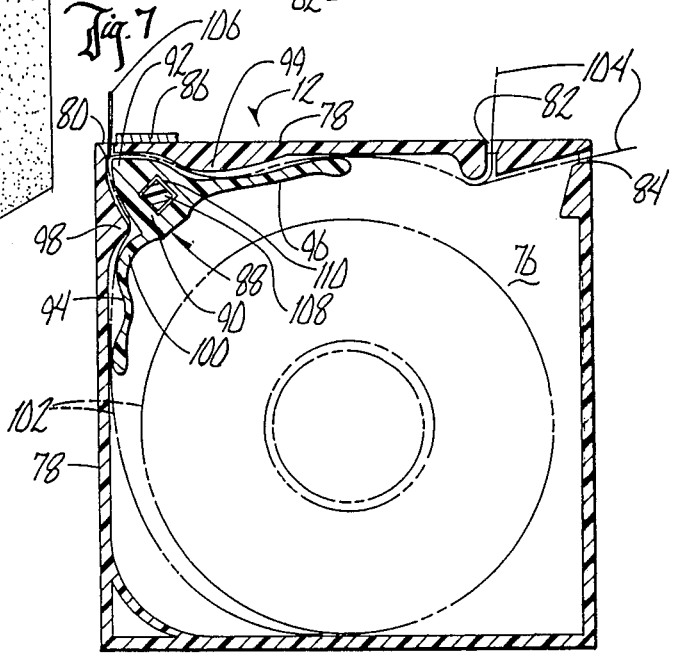
FIG. 8 is a sectional view taken along line 8—8 of FIG. 7.
Figure 9:
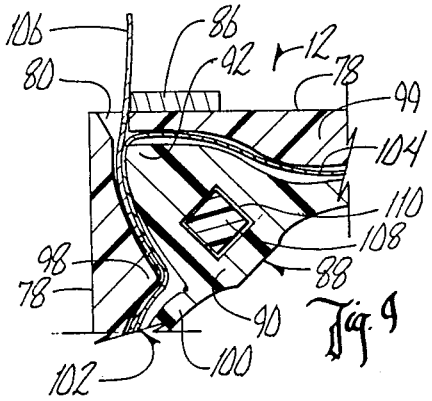
FIG. 9 is an enlarged sectional view taken along line 9—9 of FIG. 8.

Referring to FIGS. 7–9 of the drawings, an improved form of dispenser box 12 is shown. Dispenser box 12 includes a pair of opposite rectangular side walls 76, and a continuous edge wall 78 which encloses the box 12. The top portion of edge wall 78 includes a label slot 80, and two backing strip slots 82, 84. Positioned adjacent label slot 80 on the exterior thereof, is a rectangular block 86.

Within box 12 adjacent label slot 80, is a guide member 88. Guide member 88 includes a central portion 90 having a nose 92 positioned adjacent in close spaced relation to slot 80. Extending opposite directions from central portion 90 are a pair of leaf members 94, 96 which are positioned in close spaced relation to edge wall 78 of box 12, and which extend in opposite directions from slot 80. Edge wall 78 includes a pair of inwardly extending nodes 98, 99 which are positioned on opposite sides of slot 80. Leaf member 94 includes a complementary outwardly extending node 100 which is adjacent node 98.

Mounted within box 12 is a coiled label tape 102 which is shown in detail in FIG. 9. Label tape 102 comprises a continuous backing strip 104 having a continuous set of segmented labels 106 detachably adhered to backing strip 104. The label tape 102 is threaded in the space between leaf portion 94 of guide member 88 and the edge wall 78 of box 12. The tape threads through the adjacent nodes 100, 98 and at slot 80, the label strip 106 is separated from the backing strip 104 and exits through slot 80. The backing strip continues on within the box 12 and is threaded in the space between leaf portion 96 and node 99 of wall 78. The backing strip 104 is then exited from box 12 through either slot 82 or slot 84. The operator, by pulling on backing strip 104 can cause the labels 106 to be fed outwardly through slot 80.

The nose 92 of central portion 90 provides an important function in that it causes the label strip to be separated from the backing strip adjacent slot 80. The entire guide member is held rigidly in place by a post 108 which is attached to side wall 76 of box 12 and which extends through a rectangular opening 110 in guide member 88. The square post 108 prevents rotation of or other movement of the guide member 88, and holds the guide member 88 in close spaced relation to the edge wall 78 as can be seen in FIG. 8.

Thus, it can be seen that the device accomplishes at least all of its stated objectives. A plurality of rectangular label dispensers 12 can be placed within the holding frame 10 as shown in FIG. 2. The L-shaped mounting brackets 42, 58, and the belt mounting bracket 68 provide a universal ability to mount the holding bracket anywhere desired. For example, L-shaped bracket 58 can be attached to a horizontal supporting surface and the holding frame then connected to this L-shaped bracket as shown in FIG. 3. It is also possible to remove the holding frame from this L-shaped bracket and reverse its position to the opposite side of vertical member 60, thereby causing the frame to extend to the right of vertical member 60, rather than to the left as shown in FIG. 3. Similarly, the L-shaped bracket 42 can be reversed to permit left or righthand mounting of the holding frame relative to a vertical support wall 56. The belt bracket 68 permits the device to be mounted on a wearer's belt, so as to make the device portable, yet convenient for use.

The dispenser of the present invention provides an improved means for dispensing the various labels to be used. At least one of the side walls 76 of dispenser box 12 is hinged so as to be openable to permit the insertion or removal of the label tape 102.

Thus, it can be seen that the device accomplishes at least all of its stated objectives.

What is claimed is:

1. In combination:

a rectangular holding frame having a bottom support member, a top member, a pair of spaced apart end members, a back member, and a front member;

at least two rectangular label dispensers positioned in side-by-side relationship and resting on said bottom member, said label dispensers being positioned between said spaced apart end members, and also being positioned between said front and back members whereby said label dispensers are retentively held against movement within said holding frame and against removal from said holding frame;

at least one of said bottom support member, said end members, said front member and said back member being selectively movable with respect to said holding frame from a first position blocking said label dispensers from removal from said holding frame to a second position permitting removal of said label dispensers from said holding frame and universal bracket means attached to said holding frame for permitting attachment of said holding frame in a plurality of types of support structures in a variety of positions and orientations;

said bracket means comprising a first bracket and a second bracket detachably secured to said top member and one of said end members, respectively;

said first and second brackets each being L-shaped and each including first and second legs extending perpendicular to one another, said first legs each having an elongated slot therein;

first bolt means extending through said slot of said first L-shaped bracket for adjustably retentively securing said first bracket to said top member for adjustable movement therewith;

second bolt means extending through said slot of said second L-shaped bracket for adjustably retentively securing said second bracket to one of said end members for adjustable movement therewith.

2. The combination of claim 1 wherein said bracket means further comprise a belt bracket for detachably securing said holding frame to a person's belt.

3. The combination according to claim 1 wherein at least one of said label dispensers comprise:

a dispenser box having a first side wall, a second side wall parallel to and spaced from said first side wall, and an edge wall extending between said first side wall and said second side wall, said edge wall having first and second spaced apart elongated slots therein extending perpendicularly to said side walls, guide means attached within said box, said guide means comprising a central portion positioned adjacent and in close spaced relation to one of said slots and a pair of leaf portions attached to and extending away from said central portion, said leaf portions being in close spaced relation to said edge wall on opposite sides of said one elongated slot.

4. The combination of claim 3 wherein said edge wall is rectangular in cross-section and said one elongated slot being positioned adjacent one corner of said rectangular edge wall.

5. The combination of claim 4 wherein said leaf portions extend at approximate right angles to one another.

6. The combination according to claim 5 wherein a pair of inwardly extending wall nodes are provided on said edge wall on opposite sides of said one slot, said wall nodes extending inwardly from said edge wall toward said leaf portions of said guide means.

7. The combination according to claim 6 wherein at least one outwardly extending leaf node is provided on ne of said leaf portions of said guide means and extends outwardly toward said edge wall adjacent one of said wall nodes.

8. The combination according to claim 7 comprising an elongated label tape within said box, said label tape comprising a backing strip and a continuous label strip detachably adhered to said backing strip, said label tape extending between said edge wall and one of said leaf portions of said guide means, said label strip being separated from said backing strip adjacent said one slot and extending through said one slot, said backing trip extending between said other leaf portion and said edge wall and thence through the other of said slots.

9. A label dispenser comprising:

a dispenser box having a pair of opposite side walls positioned parallel and spaced apart with respect to one another, and a continuous edge wall extending between said opposite side walls so as to define an enclosed compartment within said box;

said edge wall having first and second spaced apart elongated slots therein extending perpendicularly to said opposite side walls;

guide means attached within said compartment of said box, said guide means comprising a central portion positioned adjacent and in close spaced relation to said first slot and a pair of leaf portions attached to and extending away from said central portion, said leaf portions being in close spaced relation to said edge wall on opposite sides of said first slot, said pair of leaf portions extending at approximate right angles to one another;

a pair of inwardly extending wall nodes provided on said edge wall on opposite sides of said first slot, said wall nodes extending inwardly from said edge wall toward said leaf portions of said guide means.

10. A dispenser according to claim 9 wherein at least one outwardly extending leaf node is provided on one of said leaf portions of said guide means and extends outwardly toward said sidewall adjacent one of said wall nodes.

11. A dispenser according to claim 10 comprising an elongated label tape within said box, said label tape comprising a backing strip and a continuous label strip detachably adhered to said backing strip, said label tape extending between said edge wall and one of said leaf portions of said guide means, said label strip being separated from said backing strip adjacent said first slot and extending through said first slot, said backing strip extending between said other leaf portion and said edge wall and thence through said second slot.

12. In combination:

a dispenser box having a pair of opposite side walls positioned parallel and spaced apart with respect to one another, and a continuous edge wall extending between said opposite side walls so as to define an enclosed compartment within said box;

said edge wall having first and second spaced apart elongated slots therein extending perpendicularly to said opposite side walls;

guide means secured within said compartment of said box, said guide means having a nose positioned adjacent and in close spaced relation to said edge wall adjacent said first slot;

an elongated label tape within said box and being wound into a coil having a protruding end, said label tape comprising a backing strip and a label strip detachably adhered to said backing strip;

said protruding end of said label tape extending between said edge wall and a portion of said nose of said guide means with said label strip being separated from said backing strip within said compartment adjacent said first slot and extending through said first slot to the exterior of said box, said backing strip continuing within said compartment between said nose and said edge wall and passing through said second slot to the exterior of said box;

said guide means including an opening extending therethrough, a post being fixed to one of said side walls and extending into said opening to detachably retentively hold said guide means in a predetermined position relative to said first slot.

13. A label dispenser according to claim 12 wherein said post extends perpendicular to said side walls, said post and said opening having complementary cross-sectional shapes which cause said post to hold said guide means against rotation about said post.

* * * * *